United States Patent [19]

Fujita

[11] Patent Number: 4,709,675

[45] Date of Patent: Dec. 1, 1987

[54] GOVERNOR FOR SMALL SIZE VEHICLE

[75] Inventor: Minoru Fujita, Iwata, Japan

[73] Assignee: Yamaha Hatsudoki Kabushiki Kaisha, Iwata, Japan

[21] Appl. No.: 838,466

[22] Filed: Mar. 11, 1986

[30] Foreign Application Priority Data

Mar. 12, 1985 [JP] Japan ..... 60-47498
May 7, 1985 [JP] Japan ..... 60-95614

[51] Int. Cl.[4] ..... F02D 31/00

[52] U.S. Cl. ..... 123/376; 123/10.2; 180/53.7

[58] Field of Search ..... 123/376, 400, 403, 441, 123/90.27; 74/15.66; 180/53.7

[56] References Cited

U.S. PATENT DOCUMENTS 1,294,000 2/1919 Walkup ..... 123/376
2,972,390 2/1961 Bunker et al. ..... 123/376
3,149,618 9/1964 Catterson ..... 123/376
3,483,763 12/1969 Enters ..... 180/53.7
4,615,308 10/1986 Asanomi et al. ..... 123/90.27

*Primary Examiner*—William A. Cuchlinski, Jr.
*Attorney, Agent, or Firm*—Ernest A. Beutler

[57] ABSTRACT

A governor mechanism particularly adapted for use in off the road vehicles wherein the governor is driven by an engine shaft other than the output shaft and one which is positioned in close proximity to the induction system for shortening the linkage interconnecting it to the engine speed control and for placing it in a location where it cannot become damaged. The governor is driven by the engine camshaft which operates the intake valve. In addition a disconnectable coupling is positioned between the governor shaft and the automatic speed control so that the governor can be driven continuously but the speed control can be selectively engaged and disengaged.

28 Claims, 9 Drawing Figures

Fig-1
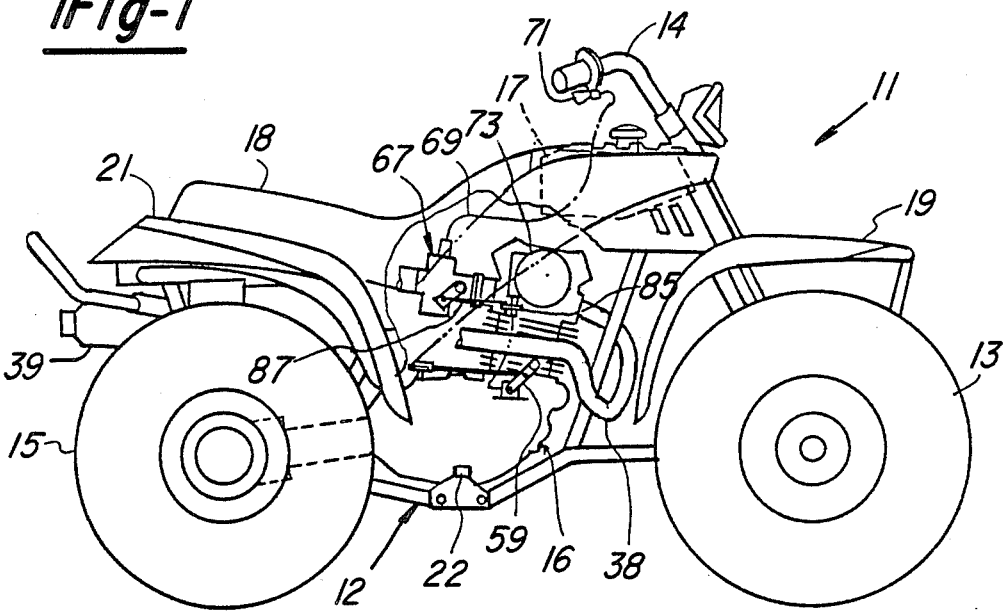
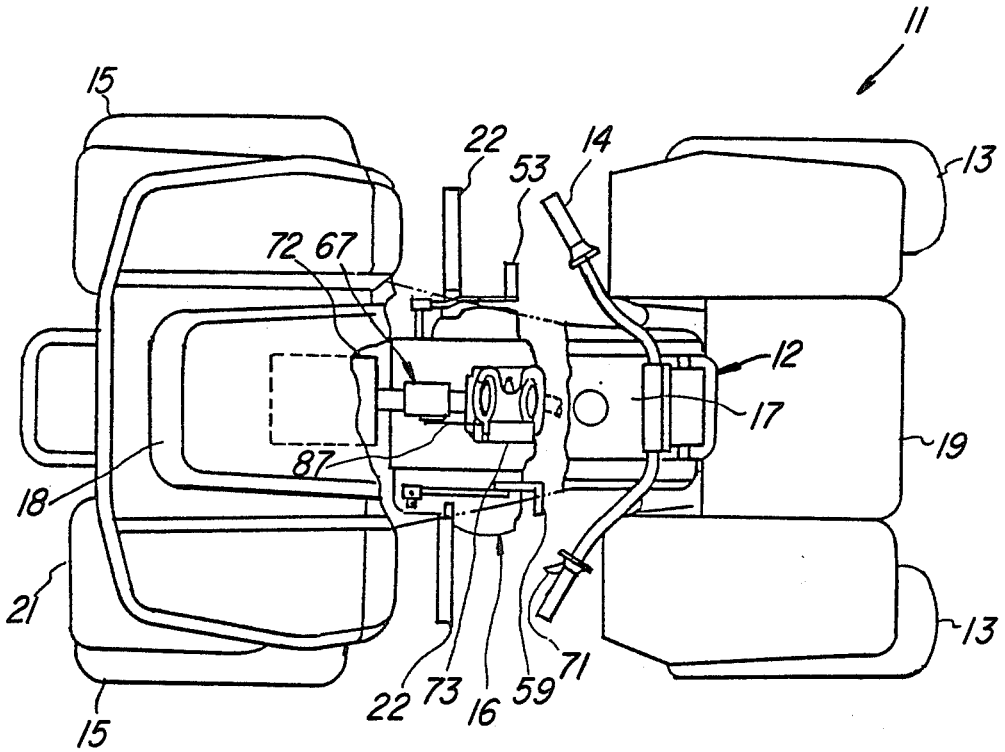
Fig-2

GOVERNOR FOR SMALL SIZE VEHICLE

BACKGROUND OF THE INVENTION

This invention relates to a governor for a small size vehicle and more particularly to an improved and simplfied governor arrangement for an internal combustion engine.

There are many instances wherein it is desirable to run an internal combustion engine at a constant or governed speed. For example, if the engine forms a component of a vehicle that is utilized both for powering the vehicle and for driving accessories from the vehicle, it is desirable to provide a governor for the engine so that the engine will run at a preset speed when driving the power takeoff. For example, there have recently been proposed a class of small single rider vehicles which may be utilized for recreational or work purposes. In connection with the work purposes, such machines may be utilized to drive lawnmowers, water sprinklers or the like. When driving such accessories, it is desirable to insure that the engine is run at a constant speed.

Most mechanical governors employed with such small internal combustion engines are driven off of the engine crankshaft or in proximity to the engine crankshaft. The governor has an output element which is connected to a throttle valve in the engine for controlling the engine speed. Because the induction system is normally positioned at the cylinder head and remotely from the crankshaft, it is necessary to provide a linkage system wherein the governor output element is operative to control the remotely positioned throttle valve. Such an arrangement has a number of disadvantages. Where the vehicle is of the type that is adapted to be operated in off the road conditions, as in the applications as aforenoted, the linkage system is disposed at a relatively low area in the vehicle wherein it can be easily damaged by driving through rough terrain and terrain in which there is foliage which can strike the linkage. In addition, such low placement for the linkage puts it in an area where it can easily become damaged or encrusted with water or other foreign material due to the terrain over which the vehicle operates. In addition, the length of the linkage system employed with this type of device, in itself, can give rise to problems.

It is, therefore, a principal object of this invention to provide an improved governor mechanism for an internal combustion engine.

It is a further object of this invention to provide an engine governor wherein the governor is located in close proximity to the automatic speed controlling element which it operates.

It is a further object of this invention to provide an improved off the road vehicle and governor mechanism for it.

In connection with vehicles of the type described, it is frequently the case that the engine is utilized to propel the vehicle through a first transmission and drives a power takeoff shaft through another transmission. A clutching mechanism is emloyed for selectively driving either the power takeoff or the vehicle. When the vehicle itself is driven, it is the normal practice to permit the operator to control the speed of the engine so as to insure good stability and so that the operator can control the speed of the vehicle as conditions change. On the other hand, when the power takeoff is driven, it has been the normal practice to permit the governor to control the engine speed. Therefore, such a mechanism must employ an arrangement for shifting between governor controlled speed and operator controlled speed. This has been done, with prior art mechanisms, by providing a clutching mechanism between the engine driving shaft and the governor input shaft for selectively controlling the governor operation. However, such arrangements require a clutch for selectively driving the governor which must carry substantial loads and also to insure good shifting and positive drive. Therefore, prior art devices of this type have been relatively heavy and expensive.

It is, therefore, a further object of this invention to provide an improved and simplified arrangement for shifting between manual and automatic speed control.

It is a yet further object of this invention to provide a governor control mechanism for an internal combustion engine wherein the governor is driven continuously but is selectively operable to drive the automatic speed control element.

SUMMARY OF THE INVENTION

A first feature of this invention is adapted to be embodied in an internal combustion engine having a cylinder block and a crankcase journaling an output shaft. An induction system is provided for the engine that includes speed control means operative to control the engine speed. The speed control means is positioned remotely from the engine output shaft. An auxiliary engine shaft is driven with the engine output shaft and is positioned closer to the speed control means than the engine output a speed responsive signal. Linkage means operatively connect the governor shaft. Governor means are driven by the auxiliary engine shaft and provide means to the speed control means for automatic speed control of the engine.

Another feature of this invention is adapted to be embodied in an arrangement for controlling the speed of an internal combustion engine having operator speed control means for controlling the engine speed and automatic speed control means for controlling the engine speed. A mechanical governor is continuously driven by the engine and has an output shaft. Mechanical coupling means including a selectively engageable and disengageable connection are provided for selectively coupling the output element to the automatic speed control means for automatic engine speed control.

BRIEF DESCRIPTION OF THE DRAWINGS

FIG. 1 is a side elevational view of a motor vehicle constructed in accordance with an embodiment of the invention.

FIG. 2 is a top plan view of the vehicle.

DETAILED DESCRIPTION OF THE PREFERRED EMBODIMENT

Figure 3:
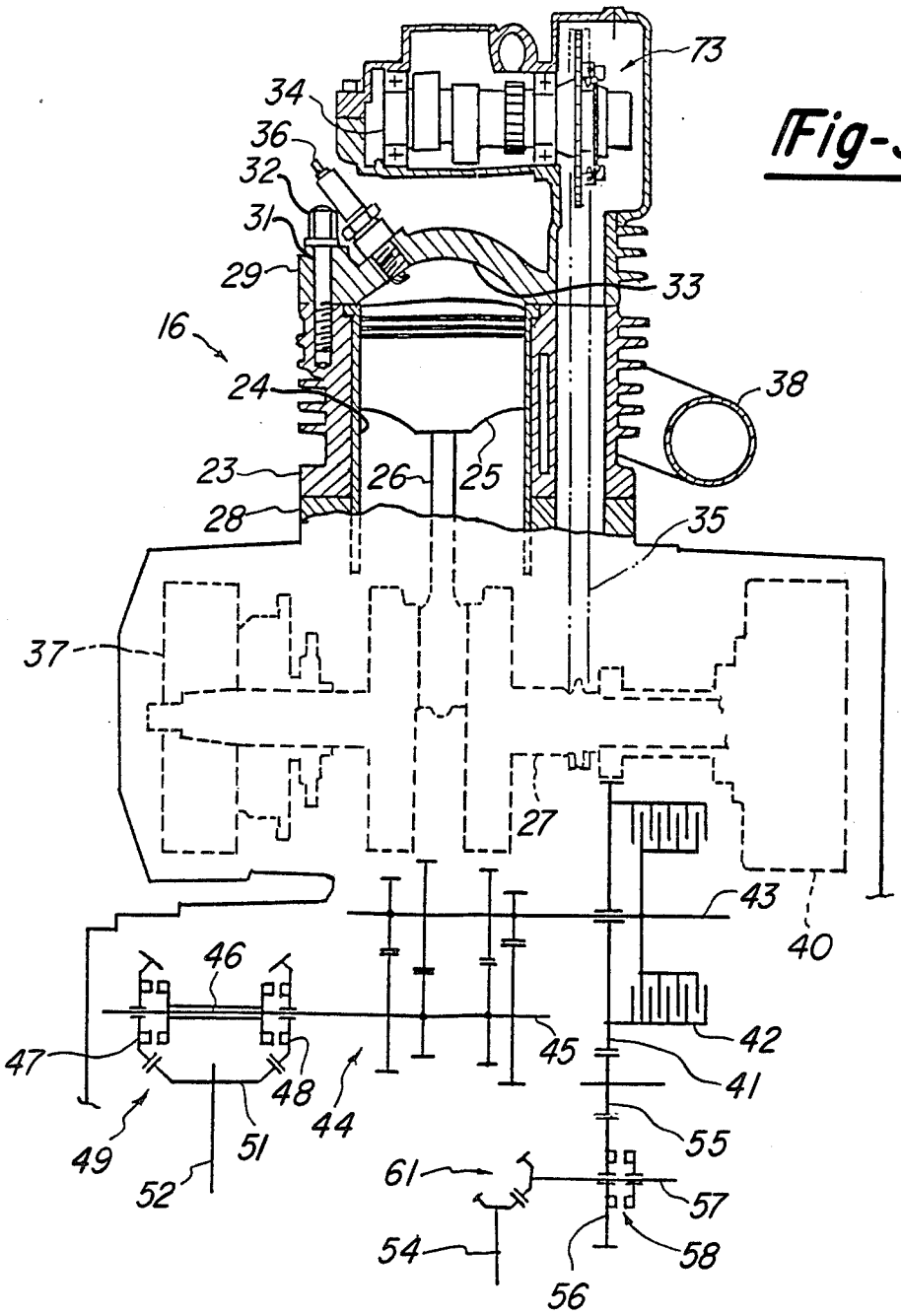
FIG. 3 is a partially schematic, partial cross-sectional view showing the engine and transmission arrangement for the vehicle.

Referring first to FIGS. 1 and 2, a vehicle constructed in accordance with an embodiment of the invention is identified generally by the reference numeral 11. The vehicle 11 is of the type that is designed to be ridden by a single rider and is designed primarily for off the road use. Specifically, the vehicle 11 is adapted to be utilized for a wide variety of recreational or work purposes such as in the agricultural field for driving a lawnmower, water sprinkler or other known types of applications for such vehicles.

The vehicle 11 includes a frame assembly, indicated generally by the reference numeral 12, and which is depicted as being of the welded up type. Suspended at the front end of the frame 12 for steering and suspension movement are a pair of front wheels that mount low pressure balloon tires 13. The use of such low pressure balloon tires adapts the vehicle 11 particularly for off the road use. The term "low pressure balloon tires" is used to describe tires of the type that are normally inflated to a pressure in the range 0.1 to 0.2 kg/cm$^2$. It is to be understood, however, that certain facets of the invention may be utilized in conjunction with vehicles of other types or, in fact, for other applications, as will become apparent.

The front wheel 13 are steered by means of a steering mechanism that includes a handlebar assembly 14 that is supported on the frame assembly 12 and which is coupled to the front wheels 13 for steering them in a known manner.

A pair of rear wheels 15, which also carry low pressure balloon tires, is carried at the rear end of the frame 12. The rear wheels 15 may be suspended, if desired, in any known manner, and are driven from a power plant assembly, indicated generally by the reference numeral 16, and which is supported within the frame assembly 12. The construction and operation of the power plant assembly 16 will be described hereinafter.

A fuel tank 17 is carried by the frame assembly 12 to the rear of the handlebar assembly 14 and above the power plant 16. Positioned rearwardly on the frame 12 from the fuel tank 17 is a saddle type seat 18 that is adapted to accommodate a single rider. A body comprised of a front fender assembly 19 which overlies the front wheels 13 and a rear fender assembly 21, which overlies the rear wheels 15, generally completes the major components of the vehicle 11. The frame 12 further includes a pair of foot pegs 22 that are positioned in a location so as to accommodate the feet of a rider seated upon the seat 18.

The construction of the power unit 16 and the mechanism for driving the rear wheels 15 will now be described by particular reference to FIG. 3. The power unit 16 includes an internal combustion engine, which in the illustrated embodiment, is depicted as of the single cylinder fourcycle type. It is to be understood, however, that the invention may be utilized in conjunction with engines of other types, as will become readily apparent to those skilled in the art.

The engine includes a cylinder block 23 in which a cylinder bore 24 is formed. A piston 25 is slidably supported within the cylinder bore 24 and is connected to one end of a connecting rod 26. The opposite end of the connecting rod 26 is journaled on a crankshaft 27 which, in turn, is rotatably journaled in the combined crankcase, transmission assembly 28 in a known manner. As is well known, the reciprocation of the piston 25 will drive the crankshaft 27.

A cylinder head 29 is affixed to the cylinder block 23 by means of studs 31 andnuts 32. The cylinder head 29 is formed with a cavity 33 which cooperates with the piston 25 and cylinder bore 24 to form the combustion chamber of the engine. An intake and an exhaust valve (not shown) are supported within the cylinder head 29 for controlling the flow of intake charge to the combustion chamber 33 and the discharge of the burnt combustion products from the combustion chamber 33. These valves are operated, in the illustrated embodiment, by means of rocker arms (not shown) which are, in turn, operated by the lobes of a camshaft 34 that is rotatably journaled within the cylinder head 29 in a known manner. The camshaft 34 is, in turn, driven at one-half crankshaft speed by means of a timing chain or belt 35.

A spark plug 36 is supported within the cylinder head 29 and has its gap disposed in the combustion chamber 33 for firing the charge in a known manner. A suitable ignition system including a crankshaft mounted magneto generator 37 is provided for firing the spark plug 36 in a known manner.

The engine is positioned within the frame 12 so that the rotational axis of the crankshaft 27 extends transversely to the longitudinal center line of the vehicle 11. An induction system (to be described) is positioned to the rear of the engine for delivering the fuel/air charge to the combustion chamber 13 through the intake valve. An exhaust system, including an exhaust pipe 38 is provided for discharging the exhaust gases that pass the exhaust valve to the atmosphere. The exhaust system 38 may include a muffler 39 (FIG. 1).

The means for driving the rear wheels 15 from the crankshaft 27 includes a transmission assembly enclosed within the combined crankcase, transmission 28 and this is shown schematically in FIG. 3. This transmission assembly includes a centrifugal clutch 39 which is driven from the crankshaft 27 and which, in turn, drives an input gear 41. The gear 41 is coupled to a multiple disk clutch 42 which, in turn, is employed for driving a primary shaft 43 of a change speed transmission, indicated generally by the reference numeral 44. The change speed transmission 44 provides a number of forward drive gear ratios for selectively driving a secondary shaft 45 of the change speed transmission 44 in a known manner.

A dog clutching member 46 is affixed for rotation to one end of the secondary shaft 45 by means of a splined connection which permits the dog clutching member 46 to be moved axially along the shaft 45 to establish a driving relationship to a selected one of a pair of gears 47 and 48 of a forward, neutral, reverse transmission, indicated generally by the reference numeral 49. The bevel gears 47 and 48 are in constant mesh with a bevel gear 51 that is affixed for rotation with a drive shaft 52. The drive shaft 52, in turn, drives the rear wheels 15 through a suitable final drive mechanism (not shown).

Thus, the change speed transmission 44 and forward, neutral, reverse transmission 49 permits the rear wheels 15 to be driven either forwardly or rearwardly from the power unit 16 in any of a plurality of selected speed rations. The change speed transmission 44 and forward, neutral, reverse transmission 49 are operated by means of a suitable operator control. In addition, a clutch pedal 53 (FIG. 2) is carried by the frame 12 in proximity to one of the foot pegs 22 for disengaging the normally engaged multiple disk clutch 42.

Because the vehicle 11 is adapted to be utilized for work functions, such as agricultural purposes, it is also provided with a power takeoff shaft 54. The power takeoff shaft 54 is selectively driven from the gear 41 by means including an idler gear 55 that is in constant mesh with the gear 41 and thus will be driven at all times when the centrifugal clutch is engaged. The idler gear 55, in turn, drives a driven gear 56 that is rotatably journaled on a shaft 57. A power takeoff clutch of the dog type 58 is provided for selectively coupling the gear 56 with the shaft 57. The dog clutch 58 is operated by means of a change over lever 59 (FIGS. 1 and 2) that is positioned on the side of the power unit 16 opposite from the clutch lever 53.

The shaft 57 drives the power takeoff shaft 54 through a bevel gear train 61. In this way, the power takeoff shaft 54 may rotate about an axis that is longitudinally disposed relative to the vehicle and which is parallel to the drive shaft 52.

Figure 4:
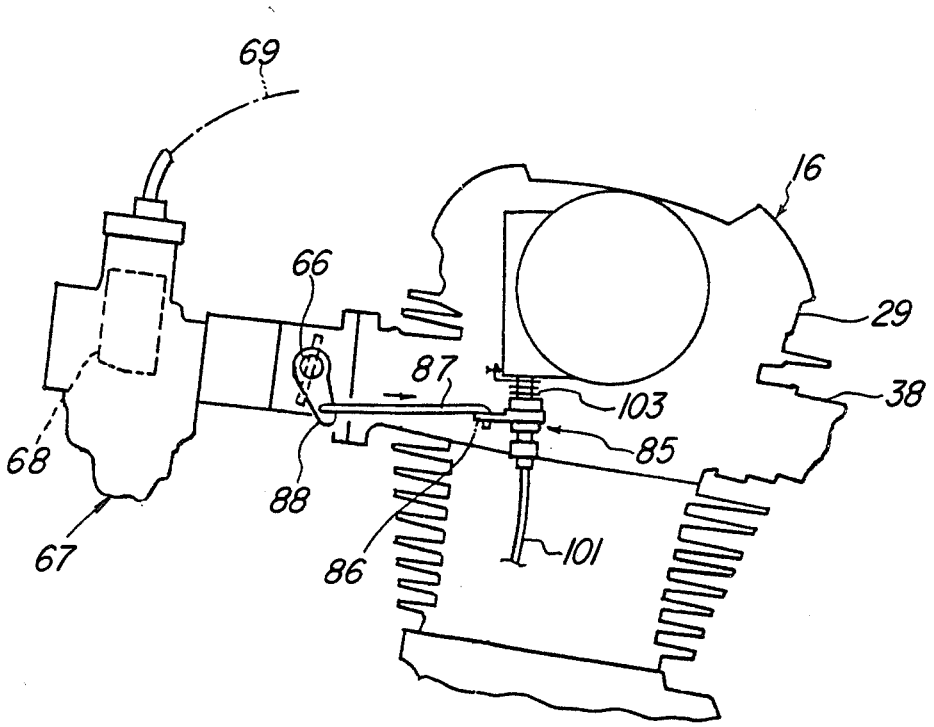
FIG. 4 is a side elevational view showing the speed control mechanism for the engine.

The induction system for the engine of the power unit 16 will now be described by particularly reference to FIGS. 4 through 6. The cylinder head 29 is formed with an intake passage 62 at one of its sides. A governor throttle valve body, indicated generally by the reference numeral 63, is affixed to the cylinder head 29 with an induction passage 64 in registry with the cylinder head intake passage 62. The governor throttle valve 65 is rotatably journaled within the governor throttle body 63 by means of a throttle valve shaft 66. The throttle valve shaft 66 is operated by means of a governor mechanism, to be described.

A carburetor, indicated generally by the reference numeral 67, is affixed to the governor throttle body 63 in a known manner. In the illustrated embodiment, the carburetor 67 is of the type having a piston type throttle valve 68. The piston type throttle valve 68 is controlled by means of a control wire 69 that is coupled to a throttle control lever 71 carried by the handlebar assembly 14.

An air cleaner assembly 72 (FIG. 2) is carried by the vehicle 11 rearwardly of the power unit 16 and carburetor 67 and beneath the seat 18 for providing a supply of clean air to the engine induction system.

A governor mechanism, indicated generally by the reference numeral 73, is provided for controlling the speed of the engine when operating in the power takeoff mode by appropriately positioning the governor throttle valve 65. The governor mechanism 73 is best shown in FIGS. 5 and 7 through 9 and will now be described by principal reference to those figures.

As has been previously noted, the camshaft 35 is driven from the engine crankshaft 27 by means of a timing chain 35. The timing chain 35 cooperates with a sprocket 74 that is affixed for rotation with the camshaft 34 by means including a bolt 75. The sprocket 74 carries a plurality of centrifugal weights 76 by means of pivot pins 77. In the illustrated embodiment, there are three such centrifugal weights 76 although only one of them appears in detail in the drawings. The weights 76 cooperate with a sleeve 78 that is slidably journaled on a cylindrical extension 79 of the sprocket 74. The construction of the centrifugal weights 76 and their pivotal support is such that an increase in rotational speed of the camshaft 34 will cause the sleeve 76 to be moved to the right as shown in FIG. 5. A spring stop 81 is juxtaposed to each centrifugal weight 76 so as to limit its degree of pivotal movement in response to speed increases.

A fork member 82 is affixed to a shaft 83 which is journaled for rotation about a generally vertically extending axis by means of a housing 84 of the governor 73. The shaft 83 is selectively couplable by means of a coupling 85 to a lever 86. The lever 86 is journaled on the lower end of the shaft 83 and is connected by means of a link 87 to a throttle 88. The throttle lever 88 is, in turn, affixed to the throttle valve shaft 66 of the governor throttle valve 65. A torsional spring 89 acts upon the throttle valve shaft 66 for normally urging the throttle valve 65 to a fully opened position, for a reason to be described.

Figure 8:
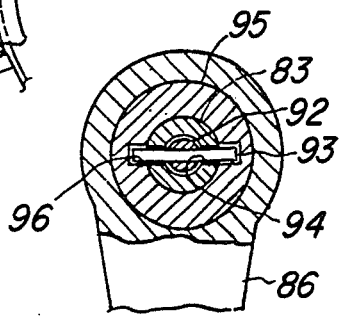
FIG. 8 is a cross-sectional view taken along the line 8—8 of FIG. 7.
Figure 9:
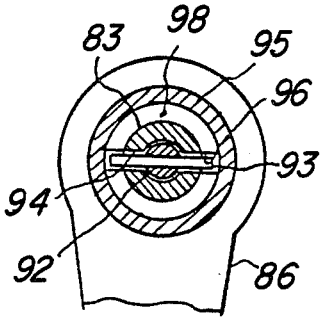
FIG. 9 is a cross-sectional view taken along the line 9—9 of FIG. 7.

The construction and operation of the coupling mechanism 85 will now be described by particular reference to FIGS. 7 through 9. The lower end of the shaft 83 is formed with a bore 91 in which a plunger member 92 is slidably supported. The plunger member 92 carries a cross pin 93 that is adapted to engage in a pair of longitudinally extending slots 94 formed in the lower end of the shaft 83 so that the plunger member 92 rotate with the shaft 83.

Figure 7:
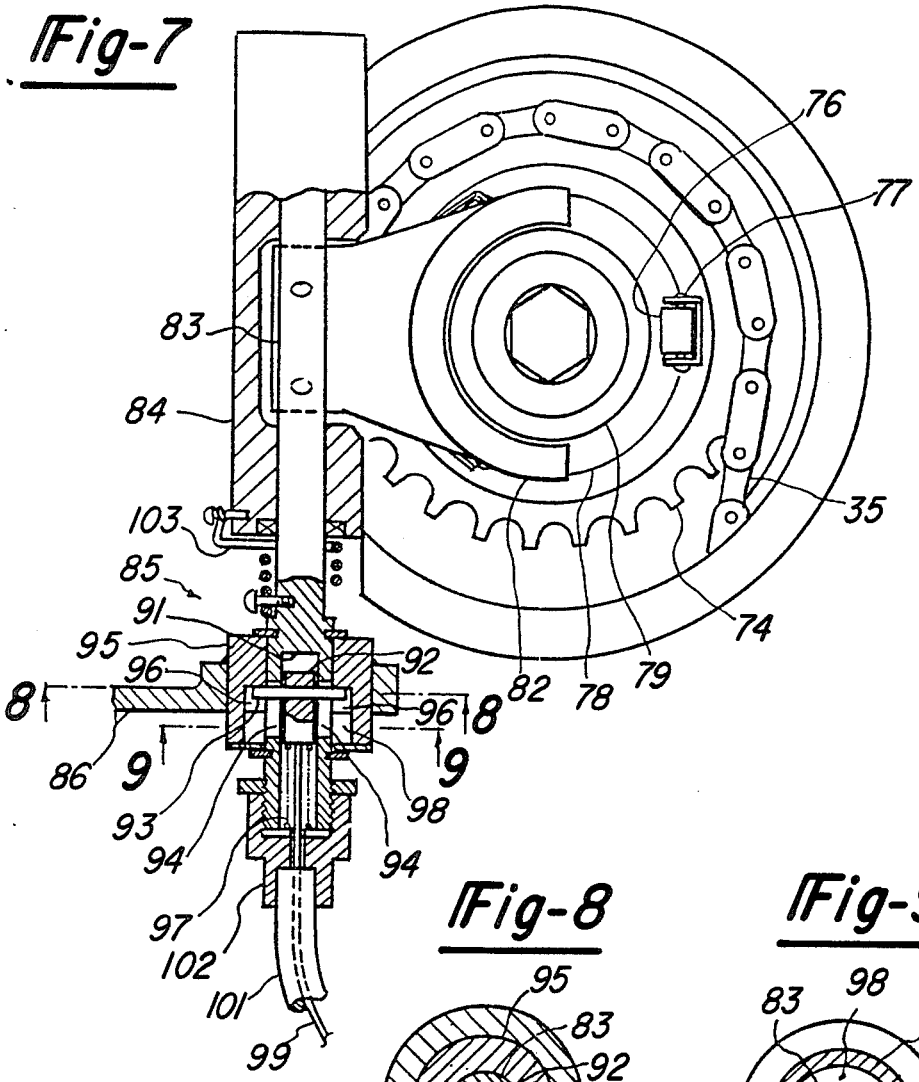
FIG. 7 is an enlarged cross-sectional view taken along the line 7—7 of FIG. 5.

The lever 86 has a hub member 95 that is formed with a pair of complementary slots 96 which are also adapted to receive the pin 93 when it is urged upwardly into the position shown in FIG. 7 by means of a coil compression spring 97. A counter bore 98 is formed below the slots 96 and is adapted to receive the pin 93 so as to permit rotation between the shaft 83 and the hub 94 when the plunger member 92 and pin 93 are drawn downwardlly.

The plunger member 93 is axially affixed but relatively rotatable to one end of a wire transmitter 99 that is supported within a protective sheath 101 which is anchored by means of a coupling member 102 relative to the governor housing 94. The other end of the wire transmitter 99 is coupled to the change over lever 59 so that when the change over lever 59 is moved to engage the dog clutch 58 so as to drive the power takeoff shaft 59, the wire 99 will be permitted to move upwardly under the action of the coil compression spring 97 so as to permit the pin 93 to enter the slots 96 and establish a driving relationship between the shaft 83 and the hub member 95. However, when the dog clutch 68 is disengaged, the wire 99 will be pulled downwardly and the governor shaft 83 may rotate freely relative to the hub 95 since the pin 93 will be no longer engaged in the slot 96.

Figure 5:
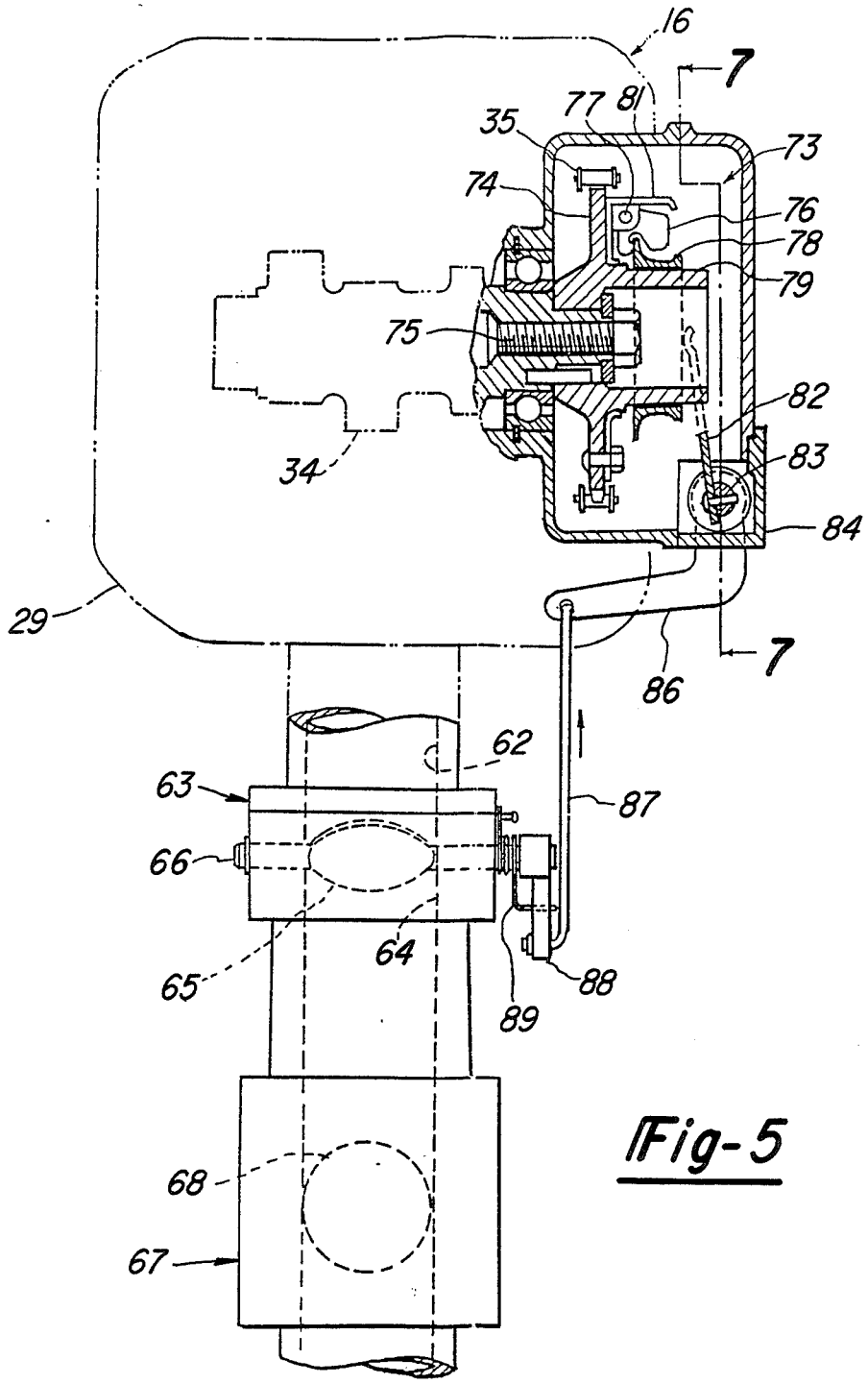
FIG. 5 is a top plan view, with portions broken away and other portions shown in section, of the speed control.
Figure 6:
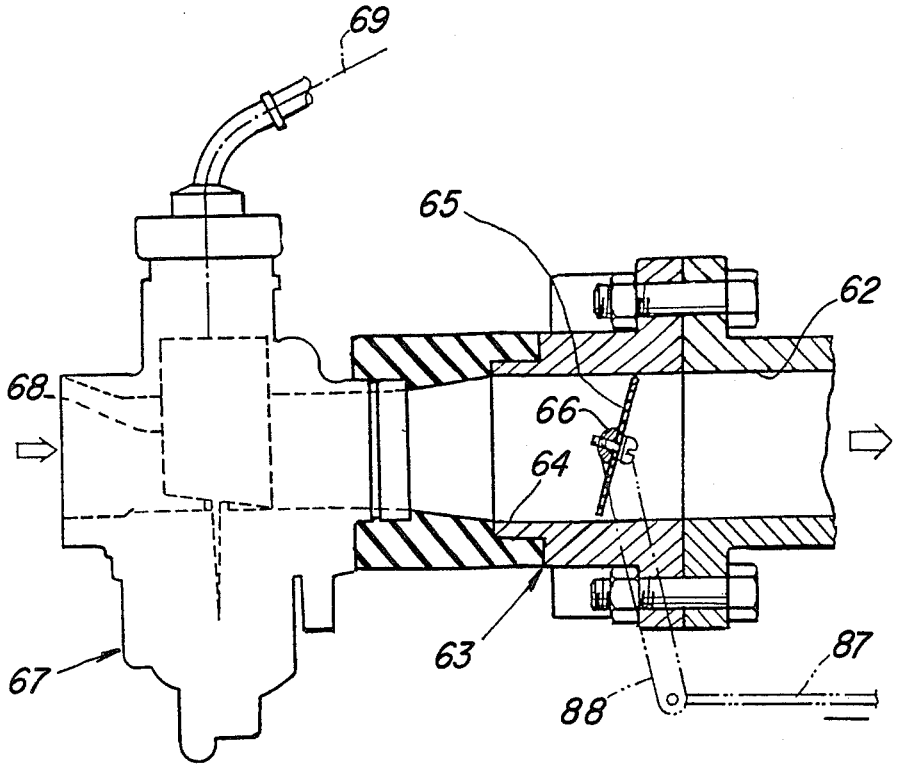
FIG. 6 is a cross-sectional view showing the engine speed control.

A torsional spring 103 engages the shaft 83 and rotates it in a direction so as to urge the governor sleeve 78 toward the sprocket 74 in the position shown in FIG. 5. Thus, when the coupling member 85 is not engaged, the sleeve 78 will be held in a position corresponding to that of wide open position of the governor throttle valve 65. At the same time, the spring 89 will hold the governor throttle valve 65 in the wide open throttle position. Hence, when the engine is not running, the slots 96 and 94 will be aligned with each other so that the pin 93 can conveniently enter the slot 96 when the change over lever 59 is shifted to the power takeoff mode.

The operation of the device will now be described with general reference to all figures. As has been noted, when the change over lever 59 is in the mode so that the dog clutch 58 is disengaged, the wire 99 will be pulled downwardly so that the pin 93 is not engaged in the slots 96 and the shaft 83 may rotate freely relative to the hub 95 and the lever 86. Under this condition, the governor throttle valve 65 will be held in its fully opened position by the torsional spring 89. Hence, entire control of the speed of the engine is under the control of the operator throttle lever 71 and carburetor throttle valve 68.

When the change over lever 59 is actuated so as to engage the dog clutch 59 and drive the power takeoff shaft 54, the manually operated throttle valve 68 is partially opened in a suitable manner. At the same time, the wire 99 will be urged upwardly by the spring 97 so as to cause the pin 93 to engage the slot 96 and establish a driving relationship between the shaft 83 and the lever 86. If the engine is operated below the governed speed, the governor throttle valve 65 will be held in the fully opened position. However, as the engine speed increases, the inertial weights 76 will cause the sleeve 78 to move outwardly so as to pivot the fork 82. This movement is transmitted through the shaft 83 and now engaged coupling 85 to the lever 86 so as to rotate it in a clockwise direction as shown in FIG. 5 so as to exert a tensional force on the link 87. This, in turn, rotates the governor throttle control lever 88 in a counterclockwise direction as viewed in FIG. 6 so as to close the throttle valve 65 of the governor and to cause the engine speed to be controlled in an obvious manner.

It should be readily apparent from the foregoing description that the fact that the governor mechanism 73 is driven from the camshaft 34 rather than the crankshaft permits a great shortening of the linkage system connecting the governor to the throttle valve. In addition, the linkage mechanism is positioned quite high due to the vertical orientation of the engine and hence the governor mechanism will be positioned in a protected location where it cannot be damaged by the terrain over which the vehicle is being operated nor will it be damaged for foreign material or water thrown up by the wheels of the vehicle. In this regard, it should be noted that the invention has been described in conjunction with a single overhead camshaft engine. If two overhead camshafts are employed, one for operating the intake valve and one for operating the exhaust valve, it is desirable to drive the governor from the intake camshaft so that it will be positioned more closely to the induction system. Alternatively, the governor mechanism may be driven from any other engine driven shaft that is positioned in proximity to the induction system. In addition, the coupling mechanism for disconnecting and connecting the governor control to the governor throttle valve offers simplicity and does not require the transmission of large powers as would be true if the governor mechanism itself were clutched and declutched from its driving shaft. Therefore, a very robust and yet uncomplicated structure has been provided that will afford a long life and trouble free operation.

It is to be understood, however, that the foregoing description is only that of a preferred embodiment of the invention and that various changes and modifications may be made without departing from the spirit and scope of the invention, as defined by the appended claims.

I claim:

1. An overhead valve internal combustion engine having a cylinder block and a crankcase journalling an output shaft, a cylinder head affixed to said cylinder block, intake and exhaust valves carried by said cylinder head, an induction system including an intake port formed in said cylinder head and communicating with a combustion chamber through said intake valve, and means fixed to said cylinder head for supplying a charge to said intake port including speed control means operative to control engine speed, said speed control means being positioned remotely from said engine output shaft and in proximity to said cylinder head, an auxiliary engine shaft journaled by said cylinder head and driven with said engine output shaft, governor means driven by said auxiliary engine shaft and providing a speed responsive signal, and linkage means operatively connecting said governor means to said speed control means for automatic speed control of said engine.

2. An internal combustion engine as set forth in claim 1 wherein the speed control means controls engine speed by controlling air flow through the induction system.

3. An internal combustion engine as set forth in claim 2 wherein the speed control means comprises a governor throttle valve.

4. An internal combustion engine as set forth in claim 1 wherein the auxiliary engine shaft is a camshaft for operating at least one of the intake and exhaust valves.

5. An internal combustion engine as set forth in claim 4 wherein the camshaft operates the intake valve associated with the engine induction system.

6. An internal combustion engine as set forth in claim 5 wherein the speed control means cooperates with the engine induction system.

7. An internal combustion engine as set forth in claim 6 wherein the speed control means controls engine speed by controlling air flow through the induction system.

8. An internal combustion engine as set forth in claim 7 wherein the speed control means comprises a governor throttle valve.

9. An internal combustion engine as set forth in claim 1 in combination with a vehicle having at least one driven wheel and one power takeoff shaft adapted to be selectively operated, the engine being positioned in the vehicle with the auxiliary engine shaft being disposed vertically above the engine output shaft.

10. An internal combustion engine as set forth in claim 9 wherein the speed control means cooperates with the engine induction system.

11. An internal combustion engine as set forth in claim 10 wherein the speed control means controls engine speed by controlling air flow through the induction system.

12. An internal combustion engine as set forth in claim 9 wherein the speed control means comprises a governor throttle valve.

13. An internal combustion engine as set forth in claim 9 wherein the auxiliary engine shaft is a camshaft for operating at least one of the intake and exhaust valves.

14. An internal combustion engine as set forth in claim 13 wherein the camshaft operates an intake valve associated with the engine induction system.

15. An internal combustion engine as set forth in claim 14 wherein the speed control means cooperates with the engine induction system.

16. An internal combustion engine as set forth in claim 15 wherein the speed control means controls engine speed by controlling air flow through the induction sytem.

17. An internal combustion engine as set forth in claim 16 wherein the speed control means comprises a governor throttle valve.

18. An internal combustion engine as set forth in claim 17 wherein the governor mechanism comprises an inertial weight supported for pivotal movement in response to engine speed.

19. An internal combustion engine as set forth in claim 18 further including linkage means for connecting the governor weight to the engine speed control means.

20. An internal combustion engine as set forth in claim 19 further including a disengageable coupling between the governor weight and the engine speed control means for permitting ungoverned engine speed operation.

21. An internal combustion engine as set forth in claim 20 wherein the disconnectable connection comprises a clutching connection between a governor shaft and a shaft for rotating a link operatively connected to the speed control means for operating the speed control means.

22. An internal combustion engine having a cylinder block and a crankcase journalling an output shaft, an induction system including speed control means operative to control engine speed, said speed control means being positioned remotely from said engine output shaft, an auxiliary engine shaft driven with said engine output shaft and positioned closer to said speed control means than said engine output shaft, governor means comprised of an inertial weight constantly driven by said auxiliary engine shaft and providing a speed responsive signal, and linkage means operatively connecting said governor weight to said speed control means for automatic speed control of said engine, said linkage means including a disengageable coupling between said governor weight and said engine speed control means for permittig ungoverned engine speed operation.

23. An internal combustion engine as set forth in claim 22 wherein the disconnectable connection comprises a clutching connection between a governor shaft and a shaft for rotating a link operatively connected to the speed control means for operating the speed control means.

24. An arrangement for controlling the speed of an internal combustion engine having operator controlled speed control means for controlling the engine speed, automatic speed control means for controlling the speed of the engine, a mechanical governor continuously driven by the engine and having an output shaft, and selectively engageable and disengageable mechanical coupling means including a selectively engageable and disengageable coupling for selectively coupling said output element to said automatic speed control means for automatic engine speed control and for disengaging said coupling for operator speed control of the engine.

25. An arrangement as set forth in claim 24 wherein the mechanical governor includes a centrifugal weight.

26. An arrangement as set forth in claim 25 wherein the selectively engageable and disengageale coupling comprises a clutch.

27. An arrangement as set forth in claim 26 wherein the clutch is a positive clutch.

28. An arrangement as set forth in claim 27 wherein the positive clutch comprises a first shaft driven by the governor and having a bore formed therein intersected by a slot, a second shaft having a slot formed therein, and a slidable pin rotatably affixed to said first shaft and selectively engageable with said second shaft slots for driving said shafts simultaneously.

* * * * *